US005958282A

United States Patent [19]

Raj et al.

[11] Patent Number: 5,958,282

[45] Date of Patent: Sep. 28, 1999

[54] LOW COST METHOD FOR MANUFACTURING FERROFLUID

[75] Inventors: Kuldip Raj, Merrimack; Lutful M. Aziz, Nashua, both of N.H.

[73] Assignee: Ferrofluidic Corporation, Nashua, N.H.

[21] Appl. No.: 09/021,228

[22] Filed: Feb. 10, 1998

Related U.S. Application Data

[60] Provisional application No. 60/037,416, Feb. 21, 1997.

[51] Int. Cl.[6] ..... H01R 1/44

[52] U.S. Cl. ..... 252/62.52; 252/62.51 R; 252/62.56

[58] Field of Search ..... 428/632, 633, 428/634; 252/62.51 R, 62.52, 62.56

[56] References Cited

U.S. PATENT DOCUMENTS

| | | | |
|---|---|---|---|
| 3,917,538 | 11/1975 | Rosensweig | 252/62.51 R |
| 4,094,804 | 6/1978 | Shimoizaka | 252/62.52 |
| 4,110,208 | 8/1978 | Neal | 210/425 |
| 5,240,626 | 8/1993 | Thakur et al. | 252/62.54 |

FOREIGN PATENT DOCUMENTS 2498587 7/1982 France .

96/10539 4/1996 WIPO .

OTHER PUBLICATIONS

*Magnetic Fluids and Applications Handbook,* cover and pp. 8–13, editor–in–chief B. Berkovski (UNESCO Paris), editor V. Bashtovoy (Minsk, Belarus), Begell House, Inc., New York•Wallingford (UK), 1996 no month.

*Ferrohydrodynamics,* cover and pp. 38–43, R.E. Rosensweig, Dover Publicatons, Inc., Mineola, NY, 1998 no month.

*Primary Examiner*—C. Melissa Koslow
*Attorney, Agent, or Firm*—Kudirka & Jobse, LLP

[57] ABSTRACT

A ferrofluid manufacturing process applies energy to a nonmagnetic $\alpha$-$Fe_2O_3$ starting material to render it magnetic and suitable for use in a ferrofluid. The material is placed, together with a solvent and a surfactant, in a commercial attrition mill where the mill action converts the nonmagnetic particles to magnetic particles. In order to eliminate a solvent replacement step which is necessary with oil carrier liquids, water is used as the grinding solvent and as the ferrofluid carrier liquid. The resulting water-based ferrofluid has a high saturation magnetization, low viscosity and good colloidal stability. Using the inventive method, a large volume of fluid can inexpensively be synthesized in a short time.

12 Claims, 4 Drawing Sheets

| SURFACTANT | | | FERROFLUID | |
|---|---|---|---|---|
| **TRADE NAME** | **SOURCE** | **COMPOSITION** | **SATURATION MAGNETIZATION (GAUSS)** | **COMMENTS** |
| Westvaco Reax 88B | Westvaco, Chemical Div., Charleston Heights, S. Carolina | Sodium Salt of Lignin Sulphonic Acid | 100 | Black color |
| Westvaco Reax M100 | Westvaco, Chemical Div., Charleston Heights, S. Carolina | Lignosulfonic Acid, Sodium Salt | 120 | Black Color |
| Chemlink IRM-700 | Baker Industrial Chemical, Houston, Texas | Proprietary | 101 | Black/Brown color |
| SSMA 3000 | Chem Link, Malvern, Pennsylvania | Sulphonated Low Molecular Weight Copolymer of Styrene and Maleic Anhydride, Sodium Salt | 43 | Brown color |
| Aerosol C-61 | Cytec Industries Inc., W. Paterson, N. Jersey | Alkylamine Guanidine Polyethyl Ethanol | 32 | Extremely foamy, Terminated |

*FIG. 3*

| DRUM NO. | PASS NO. | FERROFLUID SATURATION MAGNETIZATION (GAUSS) | FERROFLUID DENSITY (gm/ml) |
|---|---|---|---|
| 1 | 1 | 108 | 1.22 |
| 1 | 2 | 155 | 1.24 |
| 1 | 2 | 151 | 1.24 |
| 1 | 3 | 175 | 1.25 |
| 1 | 3 | 177 | 1.25 |
| 2 | 3 | 169 | 1.24 |
| 2 | 3 | 169 | 1.24 |
| 3 | 3 | 160 | 1.24 |
| 3 | 3 | 161 | 1.24 |
| 3 | 4 | 178 | 1.25 |
| 3 | 4 | 177 | 1.25 |
| 4 | 3 | 158 | 1.24 |
| 4 | 3 | 156 | 1.24 |
| 4 | 4 | 171 | 1.25 |
| 4 | 4 | 173 | 1.25 |
| 5 | 3 | 158 | 1.24 |
| 5 | 3 | 158 | 1.24 |
| 5 | 4 | 178 | 1.25 |
| 5 | 4 | 175 | 1.25 |

*FIG. 4*

LOW COST METHOD FOR MANUFACTURING FERROFLUID

This application claims priority to Provisional Application 60/037,416, filed Feb. 21, 1997.

FIELD OF THE INVENTION

This invention relates to processes for manufacturing ferrofluid in substantially larger volumes and in less time than is possible with existing techniques.

BACKGROUND OF THE INVENTION

Ferrofluids are colloidal systems containing magnetic particles, typically having a diameter of the order of 10 nm, suspended in a liquid carrier. The difference between ferrofluids and other well-known colloids is that ferrofluids specifically utilize particles which possess magnetic properties, whereas other colloids are comprised of nonmagnetic particles. Commercial ferrofluids are generally comprised of magnetite or mixed ferrite particles, although it is possible to use particles of other magnetic materials, such as iron, cobalt, nickel, chromium dioxide, iron nitride or magnetic alloys of these materials. In general, the ferrofluid is colloidally stable and has a relatively low viscosity.

In order to form a stable colloid, the particle size should be in the range of 10 nm. In practice, the particles are generally spherical in shape and are small enough to form a single magnetic domain representing a tiny permanent magnet with an associated north and a south pole. The particles are further coated with layers of surfactant to prevent agglomeration caused by magnetic and Van der Waals attractive forces. It is also possible to form a stable colloid by using either positive or negative electrical charges to keep the particles separated; these formulations are referred to as "ionic ferrofluids". The surfactant used in each type of ferrofluid is specific to the carrier because the surfactant must be chemically compatible with the carrier. The particles may be coated either with a single or double surfactant layers and may be either cationic, anionic or non-ionic in nature.

A typical ferrofluid may consist of the following volume fractions: 4% particles, 8% surfactant and 88% liquid carrier. Ferrofluids are characterized by the liquid carrier in which the particles are suspended because it is the dominant component. For example, a water-based ferrofluid is a stable suspension of magnetic particles in water, whereas an oil-based ferrofluid is a stable suspension of magnetic particles in an oil (such as a hydrocarbon, an ester, a fluorocarbon, a silicone oil or polyphenyl ether, etc.) The physical properties of a ferrofluid are also based on the selection of the liquid carrier since it is the majority component. In addition, as mentioned above, the surfactants for water- and oil-based ferrofluids are different.

Magnetic colloids can be viewed as "liquid magnets" which can be manipulated and positioned with a magnetic field to provide sealing and increase heat transfer rates. The commercial applications of ferrofluids include sealing, damping, heat transfer, noise control, material separation, sensing and parts inspection. They are used in such diverse products as exclusion seals, loudspeakers and stepper motors. The industries in which ferrofluid-based products are typically used are: the semiconductor, computer, aerospace, oil prospecting and mining industries.

Known manufacturing processes for producing ferrofluids characteristically begin by producing suitably-sized particles of a ferrous material, such as $Fe_3O_4$ (magnetite).

Magnetite particles in a subdomain size (e.g., about 10 nm) necessary for use in a ferrofluid, are not commercially available. Consequently, two methods are used to produce suitably sized particles: ball mill grinding and chemical precipitation. These methods are described in detail in a book entitled *Ferrohydrodynamics* by R. E. Rosensweig; Cambridge University Press and a book entitled *Magnetic Fluid Handbook and Applications Handbook*, editor B. Berkovoski, Begell House, Inc., New York (1996).

A typical ball mill grinding process starts with commercially-available magnetic powder, such as magnetite powder, in which the particles are of "micron size", e.g. about 0.15 to 0.3 microns (i.e. about 150 nm to 300 nm). The commercially-available magnetite particles are then ground to reduce their size about 90%, to about 10 nm. A typical ball milling process is described in the U.S. Pat. No. 3,917,538. In this process, proper amounts of magnetite powder, surfactant and a solvent are placed in a stainless steel milling jar about 40% filled with grinding media, such as ¼" carbon steel balls. For grinding to be effective, the viscosity of the solvent should be low. In a water-based ferrofluid, the water carrier is of low viscosity and consequently, it can be used as the solvent in the grinding process. In oil-based ferrofluid, the carrier liquid often has a relatively high viscosity. Consequently, a low molecular weigh solvent is often added to the oil carrier during the grinding process to reduce the viscosity. This solvent is subsequently removed by evaporation to increase the saturation magnetization in the final ferrofluid.

The rolling action of the mill causes the media to impact repeatedly the coarse magnetite breaking it into subdomain size particles and coating some of the particles at the same time with the surfactant. Because the milling media generate a relatively low shear energy, a conventional ball milling operation takes anywhere from two to six weeks to complete and the dispersion quality is poor. The colloid formed by this process generally includes uncoated particles and large aggregates and thus requires a subsequent refinement in which undesirable particles and aggregates are removed.

Moreover, the finished product often has a high viscosity due to the presence of small particles produced during the grinding process. These small particles are further known to degrade the thermal stability of the fluid. It is also believed that the process may only reduce large aggregates of useful small particles which are initially present in commercial magnetite powder. The yield is poor, preparation times are long and the associated costs are high so that the ball milling method is generally not considered to be suitable for a large scale production of commercial ferrofluids.

Magnetite particles can also be produced by chemical precipitation processes. Generally, in such processes, magnetite particles are produced by mixing ferrous and ferric salt solutions in the presence of an alkaline medium. The resultant particles are then coated with surfactant. Both water-based and oil-based ferrofluids can be produced by means of this technique. For example, U.S. Pat. No. 5,240,626 discloses the synthesis of a water-based ferrofluid in which nanosize magnetite particles are coated with a single carboxyl-functional polymer surfactant. Two separate surfactant coatings are used for magnetite particles in aqueous phase in U.S. Pat. No. 4,094,804. Lignosulphonate, a byproduct of wood pulping, was used to prepare an inexpensive water-based colloid by chemically precipitating magnetite microcrystals as disclosed in U.S. Pat. No. 4,110,208.

However, ferrofluid produced by these processes typically requires extensive processing after the particles have been generated to confine the particle sizes to an acceptable range. The resulting ferrofluid also has a high viscosity and its magnetization is low. Consequently, this fluid is not suitable for many practical applications. In addition, chemical precipitation requires the use of several chemicals, extensive processing operations such as the washing of particles, controlled heating for the attachment of surfactant and magnetic separation to separate phases. There is also chemical waste generated during the process. The colloids thus prepared are expensive.

Although many processes for manufacturing ferrofluids are known, even after 25 years of their existence, these fluids are still speciality products, produced in small amounts with high manufacturing costs. Therefore, ferrofluids presently are not commercial feasible for high volume applications, such as power transformers and material separators.

Accordingly, there is a need for a process which produces an inexpensive ferrofluid which can quickly be manufactured in large volumes. It is also desirable that such a fluid be water-based, because water-based fluids involve the use of minimum chemical ingredients and can be very low cost since the water carrier is inexpensive. It is further desirable that the ferrofluid be produced with a process that generates no waste and is not labor intensive.

SUMMARY OF THE INVENTION

In accordance with the principles of the invention, a ferrofluid manufacturing process uses a nonmagnetic iron powder as a starting material and applies energy to the nonmagnetic iron powder to render it magnetic and suitable for use in a ferrofluid.

In accordance with one embodiment, the nonmagnetic starting material is $\alpha$-$Fe_2O_3$, which is often referred to in the literature as red iron oxide. This material is commercially available in particulate size of the order of 10 nm and, thereby, requires little or no grinding for the purpose of reducing its particle size. The material is placed, together with a solvent and a surfactant, in a commercial attrition mill where the mill action converts the non-magnetic particles to magnetic particles.

In accordance with another aspect of the invention, water is used as the grinding solvent and as the ferrofluid carrier liquid. This eliminates the solvent replacement step which is necessary with oil carriers. The resulting water-based ferrofluid has a high saturation magnetization, low viscosity and good colloidal stability. Using the inventive method, a large volume of fluid can inexpensively be synthesized in a short time. A scale up to a very high production levels can be achieved easily.

BRIEF DESCRIPTION OF THE DRAWINGS

The above and further advantages of the invention may be better understood by referring to the following description in conjunction with the accompanying drawings and which:

FIG. 3 is a table illustrating characteristics of ferrofluid produced with various surfactants in accordance with the inventive method.

FIG. 4 is a table illustrating characteristics of ferrofluid produced in large volumes in accordance with the principles of the invention.

DETAILED DESCRIPTION OF THE PREFERRED EMBODIMENT

In one embodiment of the invention the starting material is a non-magnetic red iron oxide. The red iron oxide used in this embodiment was procured from the BASF Corporation, Mount Olive, N.J. The material is sold under the trade name of CARBONYL IRON OXIDE RED. The particle size range is listed to be 10–130 nm. The apparent density of powder is 0.7–0.8 kg/l and it is insoluble in water. An X-ray diffraction pattern of the powder was generated and confirmed that it was $\alpha$-$Fe_2O_3$. When a magnet was brought close to the powder it showed no magnetic attraction.

The $\alpha$-$Fe_2O_3$ starting material is processed in an attrition mill which applies a high level of shear energy to the material to convert the non-magnetic red iron oxide powder to magnetic magnetite ($Fe_3O_4$). Attrition mills can be purchased from a number of sources. In the examples below, two different machines manufactured by Union Process Company, Akron, Ohio, were used. The first attrition mill was a model 01-HDDM (1.4 liters shell capacity) which is a vertical lab attritor for processing of small amounts of materials. The second attrition mill is a model DM-20 (20 liters shell capacity) which is a horizontal attritor for medium size production. The grinding media used in these mills was carbon steel balls with diameter of 0.85 or 0.25 mm and the mills can be operated at various speeds. The attrition mill contains a rotating shaft on which is mounted a series of perforated discs which transmit kinetic shaft energy to the grinding media and the slurry in the mill. Heat generated by the process is removed by the flow of agitated suspension and by outside cooling. These mills are traditionally used in grinding and dispersion applications, for example for preparation of inks, paints and coatings.

When the model 01-HDDM lab attrition mill is used, the materials used in the grinding process are directly poured into the vessel one by one through an opening. The shaft is first rotated at a slow speed to mix the materials and then it is increased for colloid formation. When material is processed in the model DM-20 attrition mill, the process can be continuous or batched. In either case, a slurry of water, surfactant and red iron oxide is first pre-mixed in a large drum, such as a 55 gallon drum, and then dumped in the attrition mill.

Figure 1:
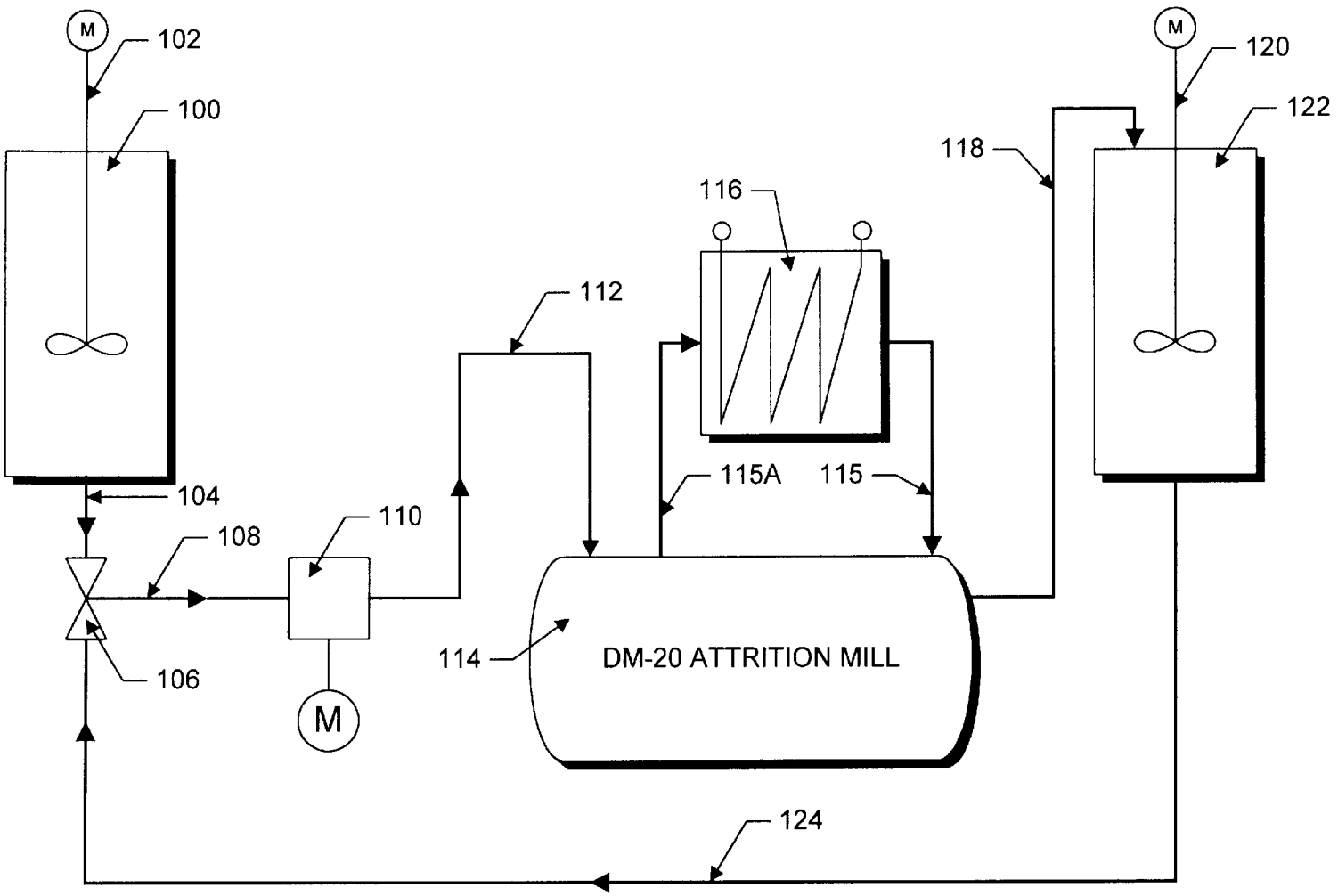
FIG. 1 is a process diagram of processing apparatus which can be used in either a batch mode or a continuous mode to produce ferrofluid in accordance with the inventive method.

FIG. 1 is a process diagram of an illustrative apparatus for either batch or continuous production of ferrofluid in accordance with the inventive process. The water solvent, surfactant and red iron oxide are added to the premix vessel 100 in the proper proportions as described below. An agitator 102 maintains the iron oxide suspended in the slurry. The slurry passes through outlet piping 104 to a valve 106 which directs the slurry, via piping 108, to a peristaltic pump 110.

From pump 110, the slurry passes via piping 112 to the DM-20 Attrition mill 114 where the slurry is ground in order to produce a stable colloid and to convert the non-magnetic iron oxide to magnetite. The mill 114 is connected via pipings and 115A to heat exchanger/cooler 116 which regulates the temperature of the mixture. The mixture then passes, via piping 118, to collection vessel 122. A second agitator 120 maintains the mixture in suspension. The mixture can be returned, via piping 124, to valve 106 and pump 110 for a second pass in the attrition mill 114 in case the desired magnetization has not been attained in a first pass through the attrition mill 114. Alternatively, the finished ferrofluid can be removed from collection vessel 122. When the apparatus is used in the batch mode, the pre-mixed slurry in vessel 100 is fed into the attrition mill 114 and ground.

The resulting colloid is collected in the collection vessel 122. When all of the contents of vessel 100 have been processed by mill 114, the entire contents of vessel 122 are transferred back, via piping 124, to vessel 100 and the grinding process is repeated.

Figure 2:
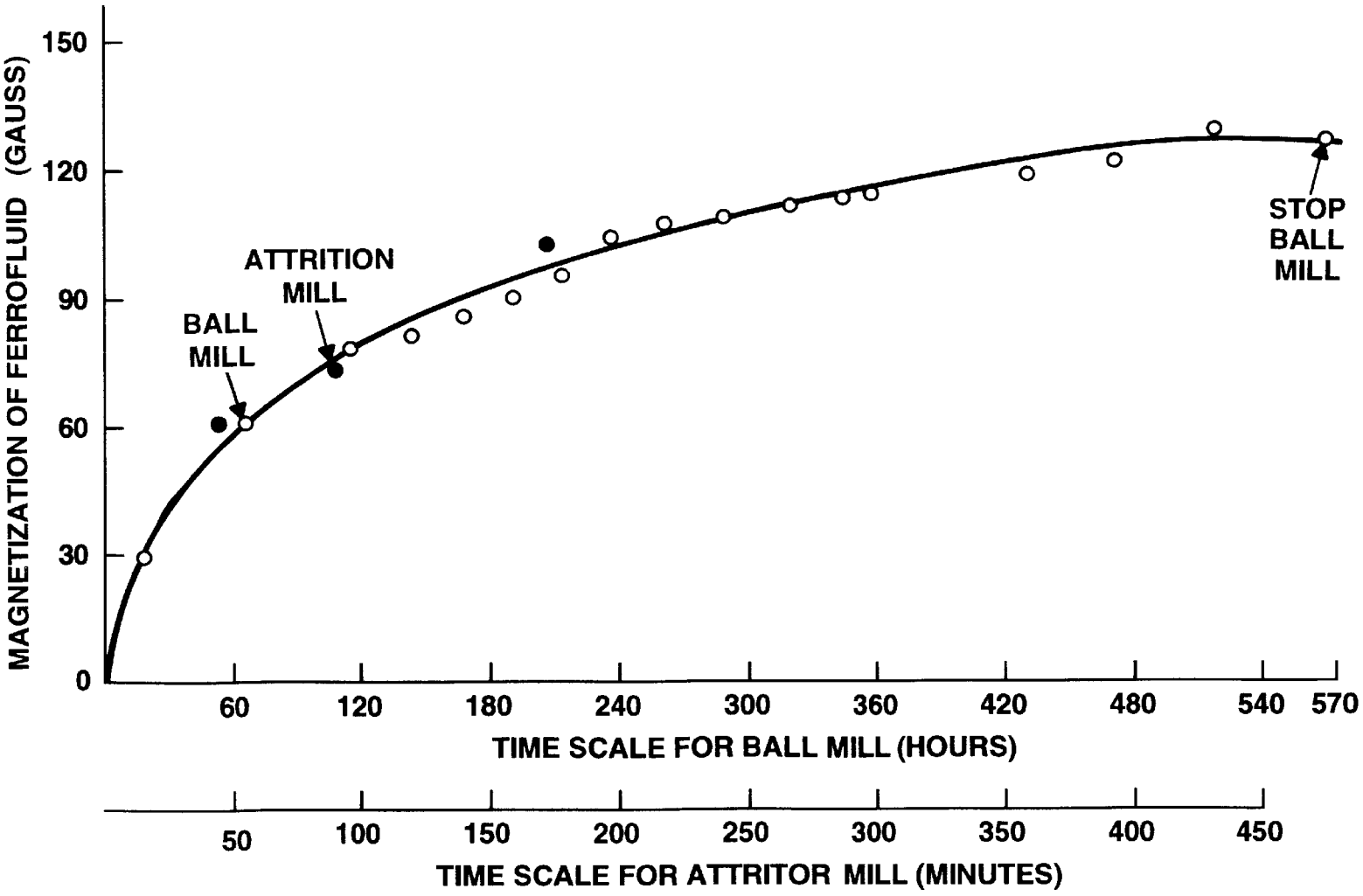
FIG. 2 is a graph illustrating a reduction in processing time when an attrition mill is used to grind the ferrofluid starting mixture in accordance with the principles of the invention as compared to the conventional use of a ball mill.

In an attrition mill, the grinding action is much more aggressive than in a ball mill. Consequently, satisfactory results can be achieved with an attrition mill in a much shorter time than with a ball mill and the use of an attrition mill is an important factor in reducing the grinding time for, and the cost of, producing the ferrofluid. As an illustration, the same water-based ferrofluid was prepared using the aforementioned lab attritor and a conventional ball mill. The constituents of ferrofluid were used in the same proportion in both the attrition mill and the ball mill. FIG. 2 shows the results of this illustration. A stable colloid with acceptable saturation magnetization is formed much more quickly with the attritor than with the ball mill. For example, a ferrofluid with a saturation magnetization of 60 Gauss was produced in 60 minutes with the attritor, but the ball mill had to be run for about 60 hours to produce a ferrofluid with an equivalent saturation magnetization.

The model 01-HDDM lab attritor was used for testing of a wide variety of surfactants for producing water-based ferrofluids. Some surfactants worked better than others and some surfactants were not suitable. The tests were conducted using the following mixture: 30 grams $\alpha$-$Fe_2O_3$, 175 cc. of deionized water, 12 grams of surfactant and 400 cc. of 0.85 mm carbon steel grinding balls. In each test, the $\alpha$-$Fe_2O_3$ iron oxide powder, deionized water, and a chosen surfactant were all fed into the model 01-HDDM lab attritor separately as described above and mixed a low speed before grinding began.

Each grind was 6 hours long at an attritor shaft speed of 3500 RPM. No cooling water was used during the grind. The temperature of the slurry reached approximately 70° C. when steady state was achieved. The resulting ferrofluid was characterized by its saturation magnetization and color. A high quality ferrofluid has a high saturation magnetization and a uniform black color. Ferrofluids with low saturation magnetizations have limited uses. A brown color indicates that the surfactant is chemically incompatible with the other ingredients and that the particles have not been coated properly. The results for a number of surfactants are summarized in FIG. 3. Other surfactants were also tried but either did not coat the particles or foamed excessively and were, therefore, not satisfactory.

The same recipe was used for preparation of iron oxide slurry for large scale production of ferrofluid using the model DM-20 attrition mill with the processing apparatus illustrated in FIG. 1. Only one surfactant type was employed in tests using the DM-20 attrition mill, namely, Westvaco Reax 88B surfactant.

In these tests, 40 kilograms of $\alpha$-$Fe_2O_3$ red iron oxide were placed in a 55 gallon drum. Fifteen kilograms of Reax 88B surfactant was added and then 40 gallons of deionized water was added. The ingredients were stirred and mixed to obtain 45 gallons of a homogeneous slurry.

Forty-five gallon batches of this slurry were then processed using the apparatus in FIG. 1 operating in a batch mode. The mixture from vessel 100 was fed to the attrition mill 114 at a rate of 20 gallons per hour. The entire output of the mill was collected in an empty vessel 122. This operation constituted "pass #1." The total contents of vessel 122 was then transferred to vessel 100 for a second pass. This process was repeated a total of four passes for each 45 gallon batch. The total time of each pass was approximately two hours.

The results for five 45 gallon batches are shown in FIG. 4. The particle size measurement in each batch was about 90Å. In about 8 hours, 45 gallons of "ready to use" ferrofluid was produced with this process. The saturation magnetization of the fluid was 165 Gauss. The results yielded a saturation magnetization range of 108–178 Gauss. When at least a second pass had been performed, a second, more consistent, range had been achieved from 151–178 Gauss. The use of a larger capacity attritor will allow more throughput. There was no waste generated during the preparation.

Attempts were also made to synthesize water-based ferrofluids using both the lab attritor and ball mill with the best black magnetite powders (in terms of particle size) available in the market place. The same recipe was used as for milling of red oxide. Additionally, the surfactant used was Westvaco Reax 88B which was known to work well with red iron oxide. One magnetite source powder was a product designated as "BASF Micromagnetite" produced by the BASF Corporation, Mount Olive, N.J. This powder had a particle size of 0.15 micron. Another other magnetite powder source was a product designed as HPX-6173, manufactured by Harcros Pigment Inc., Fairview Heights, Ill., with particle size of 45 nm. Our results of these experiments showed that the colloids thus formed were not very stable and there was a lot of settling of particles. The magnetization of ferrofluids was low (~10 Gauss). The yield with the attritor was, however, better than the ball mill.

The present invention enables the manufacture of the colloidal ferrofluids in a substantially shorter period of time than with prior techniques. The processing time may be reduced from hours to minutes or from days to hours, thereby enabling the economical manufacture of ferrofluids in commercial volumes. The resultant water-based ferrofluid has a high saturation magnetization, low viscosity and good colloid stability. A large volume of fluid can be inexpensively synthesized in a short time and the process easily scales to a very high production volume. The technique is automated, requires minimal supervision and has a small number of steps. There is no waste generated during the synthesis as only three components are used for making the fluid.

Additionally, when this water-based ferrofluid is prepared with a cationic surfactant, as discussed in U.S. Pat. No. 3,917,538, Rosensweig, the magnetic particles can be flocked irreversibly and can be inexpensively processed by resuspending them with the choice of a new surfactant into another medium such an oil carrier.

While this invention has been particularly shown and described with references to preferred embodiments thereof, it will be understood by those skilled in the art that various changes in form and detail may be made therein without departing from the spirit and scope of the invention as defined by the appended claims.

What is claimed is:

1. A method for making a ferrofluid, the method comprising the steps of:

(a) combining particles of $\alpha$-$Fe_2O_3$, water and a lignosulfonate-based surfactant to form a slurry;

(b) placing the slurry in an attrition mill; and (c) operating the attrition mill for a period of time sufficient to convert the $\alpha$-$Fe_2O_3$ particles to magnetic iron oxide particles.

2. The method as described in claim 1 wherein the surfactant is a sodium salt of lignosulfonic acid.

3. The method as described in claim 1 wherein the $\alpha$-$Fe_2O_3$ particles have a size ranging between 10 nm and 130 nm.

4. The method as described in claim 1 wherein the water is deionized.

5. The method as described in claim 1 wherein step (b) comprises the step of:

(b1) further placing steel grinding media in the attritor mill.

6. The method as described in claim 5 wherein the steel grinding media are 0.25 mm carbon steel balls.

7. The method as described in claim 5 wherein the steel grinding media are 0.85 mm carbon steel balls.

8. A method for making a ferrofluid, the method comprising the steps of:

(a) forming a slurry which is, by weight, 19.4% $\alpha$-$Fe_2O_3$ powder, 73.3% water and 7.3% sodium salt of lignosulfonic acid;

(b) placing the slurry in an attrition mill; and (c) operating the attrition mill for a period of time sufficient to convert the $\alpha$-$Fe_2O_3$ particles to magnetic iron oxide particles.

9. The method as described in claim 8 wherein the period of time in step (c) is sufficiently long such that the produced ferrofluid attains a saturation magnetization in the range of 108–178 Gauss.

10. The method as described in claim 8 wherein the period of time in step (c) is sufficiently long such that the produced ferrofluid attains a saturation magnetization in the range of 151–178 Gauss.

11. The method as described in claim 8 wherein step (b) comprises the step of:

(b1) placing carbon steel grinding media in the attrition mill.

12. The method as described in claim 11 wherein the steel grinding media are 0.85 mm carbon steel balls.

* * * * *